US007364129B1

(12) United States Patent
Levari, Jr.

(10) Patent No.: US 7,364,129 B1
(45) Date of Patent: Apr. 29, 2008

(54) COLLAPSIBLE STAND

(76) Inventor: Robert Levari, Jr., 1405 Forest Grove Rd., Vineland, NJ (US) 08360

( * ) Notice: Subject to any disclaimer, the term of this patent is extended or adjusted under 35 U.S.C. 154(b) by 0 days.

(21) Appl. No.: 11/601,984

(22) Filed: Nov. 20, 2006

(51) Int. Cl.
*A47H 1/14* (2006.01)

(52) U.S. Cl. ..... 248/460; 248/459; 248/462; 248/165; 108/4; 108/6; 211/71.01; 211/72

(58) Field of Classification Search ..... 211/71.01, 211/72, 85; 108/4, 6, 99, 100, 162, 166; 248/459, 460, 462, 463, 165, 166, 150, 455, 248/456, 464, 465, 447, 454, 447.1, 448, 248/449
See application file for complete search history.

(56) References Cited

U.S. PATENT DOCUMENTS

| | | | | | |
|---|---|---|---|---|---|
| 35,781 | A * | 7/1862 | Ritter | 312/140.2 |
| 70,339 | A * | 10/1867 | Keritz | 108/9 |
| 103,682 | A * | 5/1870 | Sullivan | 248/455 |
| 245,639 | A | 8/1881 | Lay | |
| 327,816 | A * | 10/1885 | Newbourg | 248/460 |
| 348,706 | A * | 9/1886 | Weiner | 108/115 |
| 532,777 | A | 1/1895 | Glaser et al. | |
| 681,976 | A * | 9/1901 | Rathvon | 248/456 |
| 789,813 | A * | 5/1905 | Longley | 248/396 |
| 1,571,131 | A * | 1/1926 | McIntosh | 248/456 |
| 1,972,214 | A * | 9/1934 | Bergman | 281/45 |
| 2,730,835 | A * | 1/1956 | Weir | 248/449 |
| 3,139,255 | A * | 6/1964 | Palm | 248/150 |
| 3,577,936 | A * | 5/1971 | Emery | 108/8 |
| 4,066,171 | A * | 1/1978 | Fowlie | 211/69.1 |
| 4,522,364 | A * | 6/1985 | Charney et al. | 248/460 |
| 4,966,258 | A | 10/1990 | Hawley | |
| 5,078,056 | A * | 1/1992 | McCauley | 108/115 |
| 5,941,352 | A | 8/1999 | Lee | |
| 6,105,508 | A | 8/2000 | Ryburg | |
| 6,471,019 | B1 | 10/2002 | Miller | |
| 6,932,427 | B2 | 8/2005 | Tamura | |
| 7,017,878 | B2 * | 3/2006 | Guo et al. | 248/309.1 |
| 2002/0050009 | A1 | 5/2002 | Ley | |

* cited by examiner

*Primary Examiner*—Kimberly Wood
(74) *Attorney, Agent, or Firm*—Norman E. Lehrer

(57) ABSTRACT

A portable, collapsible stand includes first, second and third substantially rectangularly shaped and rigid panels hinged together so as to be movable between a closed position and an open position. Flexible straps extend between the panels to prevent them from fully opening. Hooks located adjacent the top edge of the first panel allow the stand to be suspended from a horizontally arranged support such as the handle of a piece of luggage or the back of an airplane seat. When so suspended, the panels are in partially opened positions with respect to each other so that the first panel can function as a desk, computer support or a head rest. The second panel includes a plurality of openings formed therein for holding a drinking cup or a pen or other writing utensil. In lieu of suspending the stand, rigid rods or bars movable into position between the panels can maintain them in their open position. Feet at the bottom of the third panel allow the stand to sit on a desk or table or other horizontal surface.

8 Claims, 4 Drawing Sheets

COLLAPSIBLE STAND

BACKGROUND OF THE INVENTION

The present invention is directed toward a portable and collapsible workstation stand and more particularly, toward a stand that may be attached to a piece of luggage, the back of a chair or airplane seat or used alone and which may be used as a desk or headrest.

An increasing number of people today must work while traveling or find that they are traveling more for work. Also, many business people have portable offices. In which case, they do not have traditional offices so all of their work is done in transit. In any of these situations, very rarely is a suitable work area available in airports, train stations, bus terminals, and the like. As a result, travelers may feel that they are being unproductive as they wait for an airplane, train, or bus.

Another problem that occurs while business people are traveling is that people are often carrying luggage as well office equipment such as laptop computers while traveling. Trying to carry all of these personal items can become burdensome and cumbersome.

A further problem associated with the use of public transportation is the inability to rest while waiting for a particular mode of transportation. Frequently, airplanes, trains, and buses may run behind schedule or there may be a large gap between connecting flights, trains, or buses. Often the space in waiting rooms or areas is limited so a person may not be able to rest comfortably.

The above-mentioned trends have become quite evident and solutions have been proposed that seek to alleviate the problems associated with working while traveling. For example, U.S. Pat. No. 6,105,508 to Ryburg discloses a wheeled suitcase with a collapsible table attached thereto. This device, however, does not appear to work effectively without a luggage carrier.

Also, U.S. Pat. No. 6,471,019 to Miller discloses a travel case with a deployable and retractable tray table assembly mounted thereto. Again, however, this table does not appear to be functional without the luggage carrier.

Therefore, a need exists for a portable, collapsible stand that may be attached to luggage, to a seat back or used alone and may be used as a desk, a support surface for a portable computer, or as a headrest.

SUMMARY OF THE INVENTION

The present invention is designed to overcome the deficiencies of the prior art discussed above. It is an object of the present invention to provide a portable, collapsible stand that may be attached to a luggage carrier and be used as a desk, a support surface for a portable computer, or a headrest.

It is another object of the present invention to provide portable, collapsible stand that may rest on a horizontal surface and be used as a desk, portable computer support, or a headrest.

It is a further object of the present invention to provide a portable, collapsible stand that may be secured to a vertical surface and be used as a desk, a portable computer support, or headrest.

In accordance with the illustrative embodiments demonstrating features and advantages of the present invention, there is provided a portable, collapsible stand which includes first, second and third substantially rectangularly shaped and substantially rigid panels hinged together so as to be movable between a closed position and an open position relative to each other. Flexible means extend between the panels to prevent them from fully opening.

Hooks located adjacent the top edge of the first panel allow the stand to be suspended from a horizontally arranged support such as the handle of a piece of luggage or the back of an airplane seat. When so suspended, the panels are in partially opened positions with respect to each other so that the first panel can function as a desk, computer support or a head rest. The second panel includes a plurality of openings formed therein for holding a drinking cup or a pen or other writing utensil. In lieu of suspending the stand, rigid rods or bars movable into position between the panels can maintain them in their open position. Feet at the bottom of the third panel allow the stand to sit on a desk or table or other horizontal surface.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
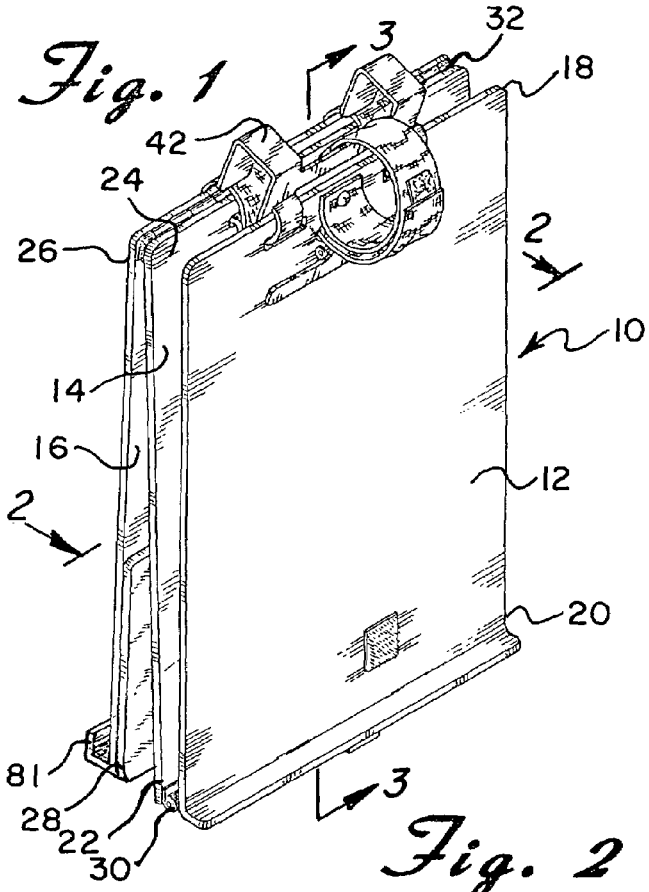
FIG. 1 is a front perspective view of the portable stand of the present invention in shown in its collapsed or folded position for storage.
Figure 2:
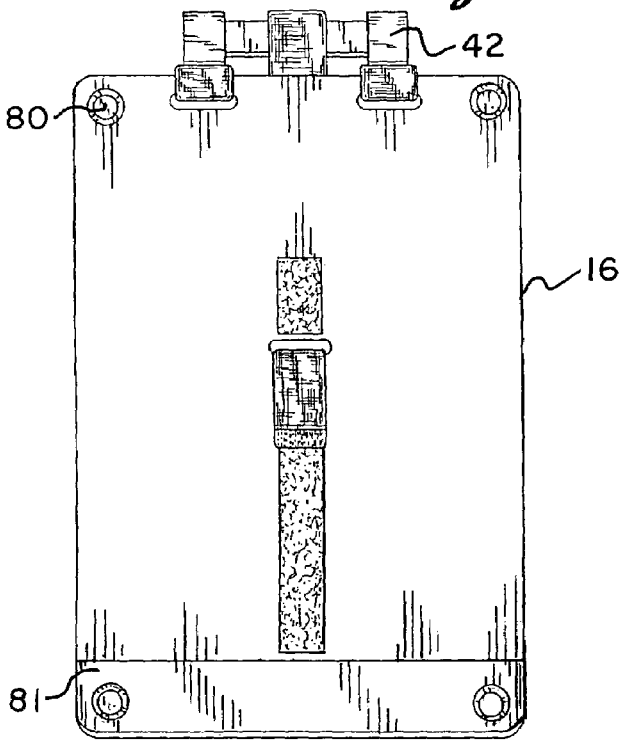
FIG. 2 is a rear perspective view of the invention taken along the line 2-2 of FIG. 1.

Referring now to the drawings in detail wherein like reference numerals have been used throughout the various figures to designate like elements, there is shown in FIG. 1 a portable, collapsible stand constructed in accordance with the principles of the present invention and designated generally as 10.

The stand of the present invention essentially includes a first or upper panel 12, a second or middle panel 14 and a third or lower panel 16. The panels 12, 14 and 16 are substantially rigid and, in the preferred embodiment, are substantially rectangularly shaped. Each panel also has an upper edge and a lower edge that are identified as edges 18, 20, 22, 24, 26 and 28. As can be seen, all of the edges 18, 20, 22, 24, 26 and 28 are essentially parallel to each other. A hinge 30 connects the lower or second edge 20 of the first panel 12 to the upper or first edge 22 of the second panel 14 while a similar hinge 32 connects the lower or second edge 24 of the second panel 14 to the upper or first edge 26 of the third panel 16.

Figure 3:
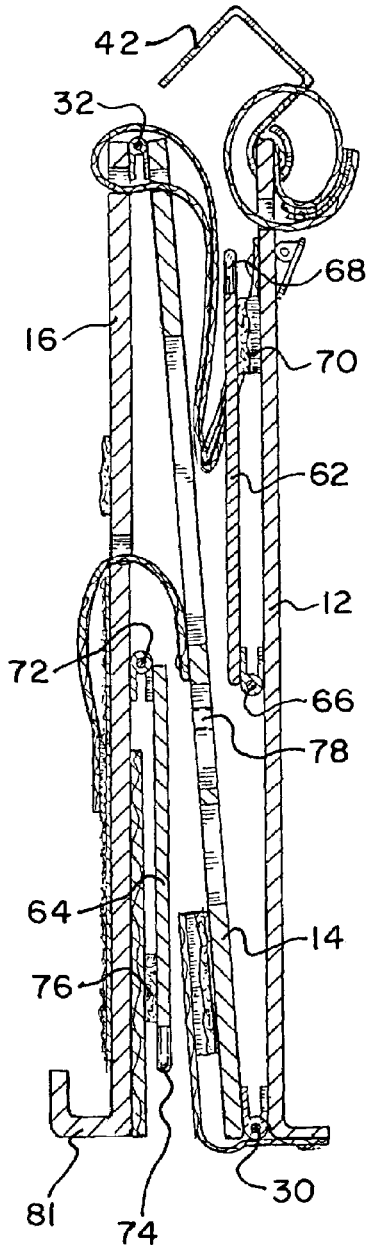
FIG. 3 is a cross-sectional view taken through line 3-3 of FIG. 1.
Figure 4:
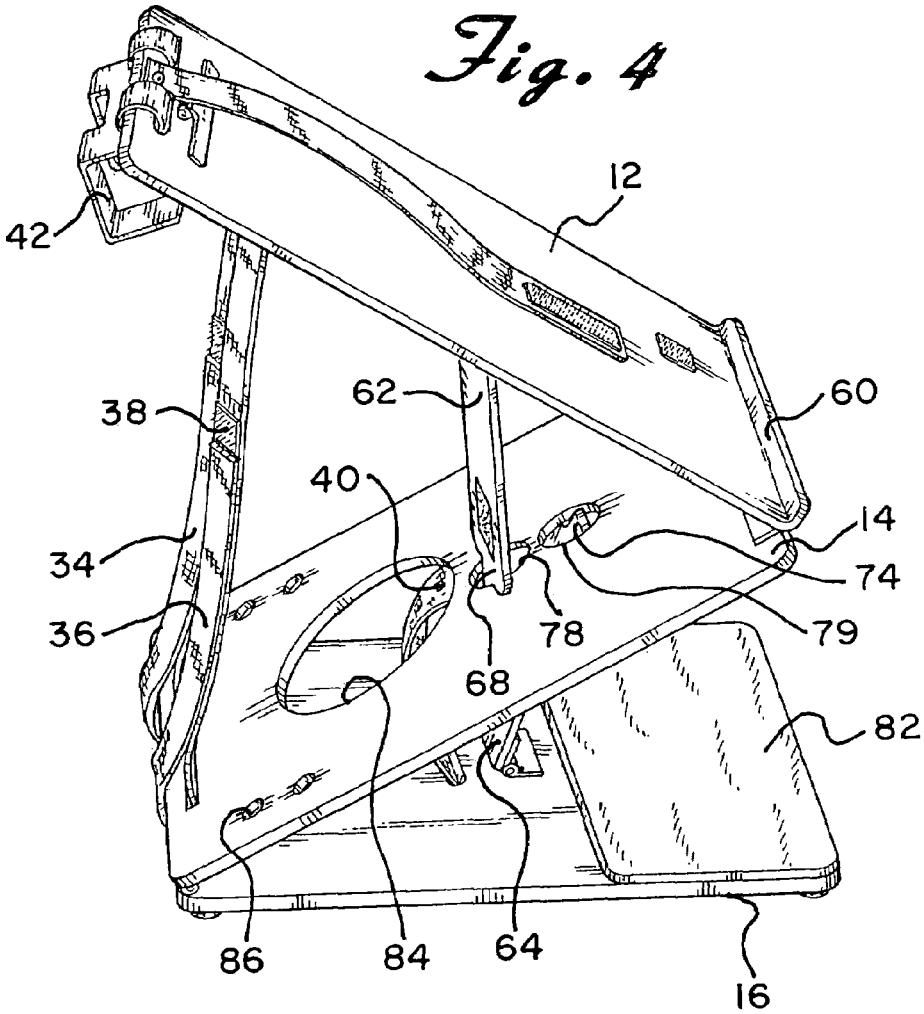
FIG. 4 illustrates the portable stand of the present invention in an open and free standing position.
Figure 5:
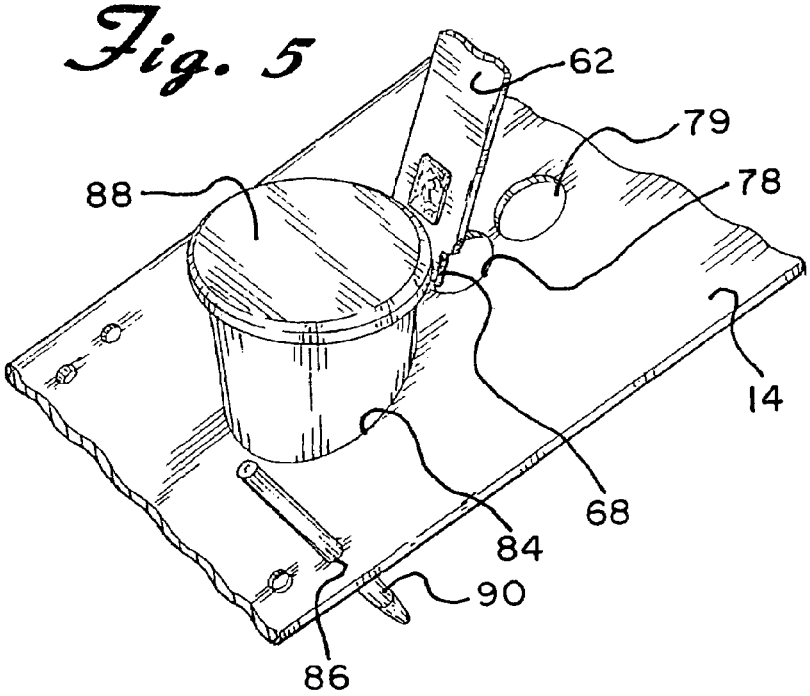
FIG. 5 illustrates a cup and pencil being supported in the stand of the present invention as shown in FIG. 4.
Figure 6:
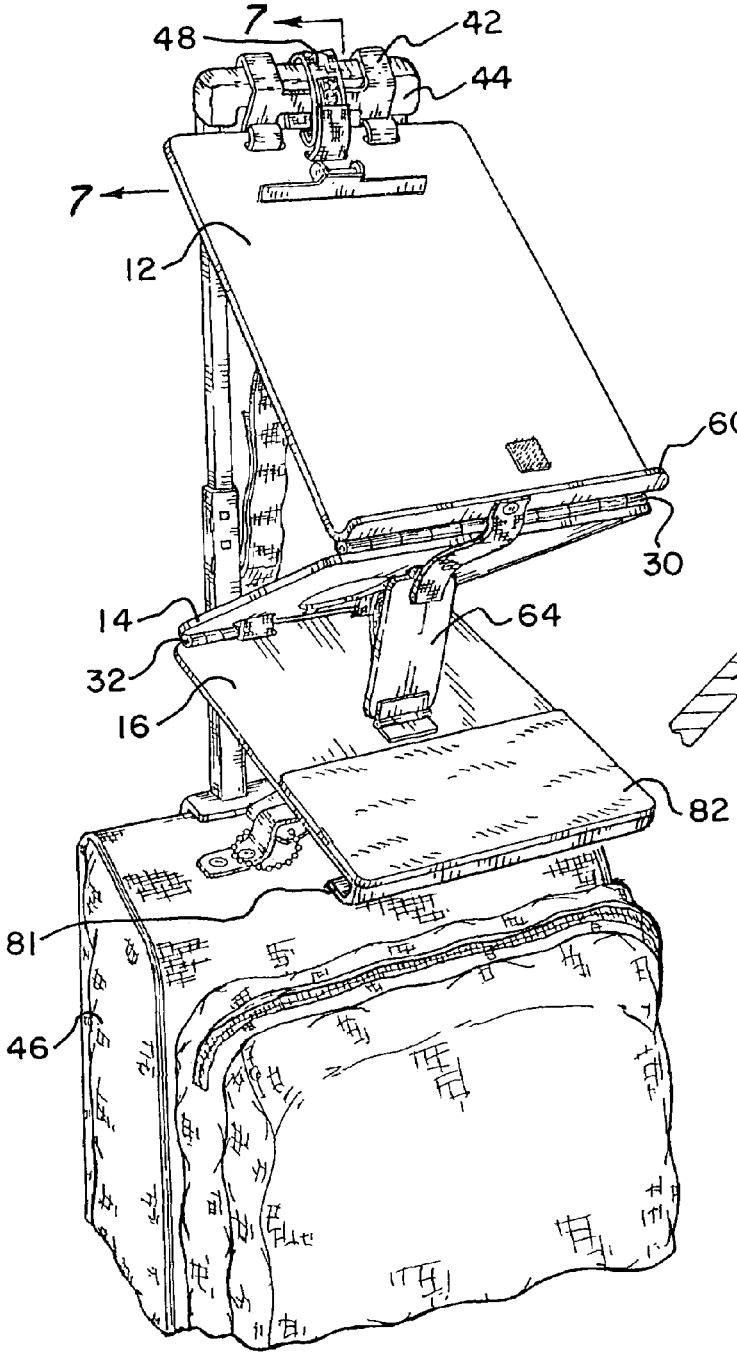
FIG. 6 illustrates the stand of the present invention being supported by the telescoping handle on a piece of luggage.
Figure 7:
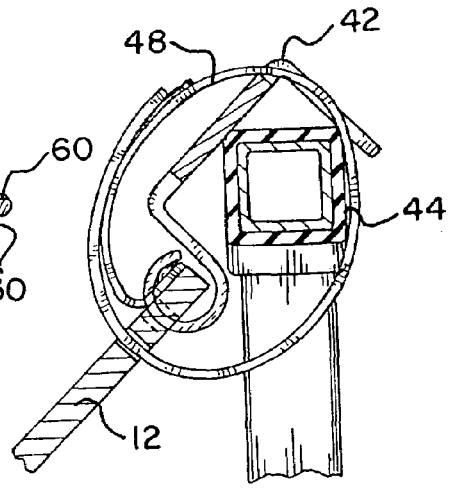
FIG. 7 is a cross-sectional view of the upper portion of the stand taken through line 7-7 of FIG. 6.

The hinges 30 and 32 allow the first and second panels 12 and 14 and the second and third panels 14 and 16 to move between closed positions wherein they lie essentially against each other as shown in FIGS. 1 and 3 and an open position as shown in FIGS. 4 and 6. Flexible straps 34 and 36 extending between the first and second panels 12 and 14 prevent the panels from fully opening with respect to each other. The amount that they can open can be adjusted through the use of Velcro or similar fasteners 38 at one end of each of the straps 34 and 36. A similar flexible strap 40 extends between the second panel 14 and the third panel 16 to prevent those two panels from fully opening with respect to each other.

Located at the top or first edge 18 of the first panel 12 is a hook 42. As best shown in FIG. 6, the hook 42 can be used to suspend the workstation stand 10 from a horizontally arranged support such as the handle 44 of a rolling suitcase 46. To prevent the device from inadvertently being dislodged from the handle 44, an additional flexible strap 48 attached to the upper edge 18 of the panel 12 can loop around the handle 44 and can be closed utilizing Velcro or some other similar fastening means.

Figure 10:
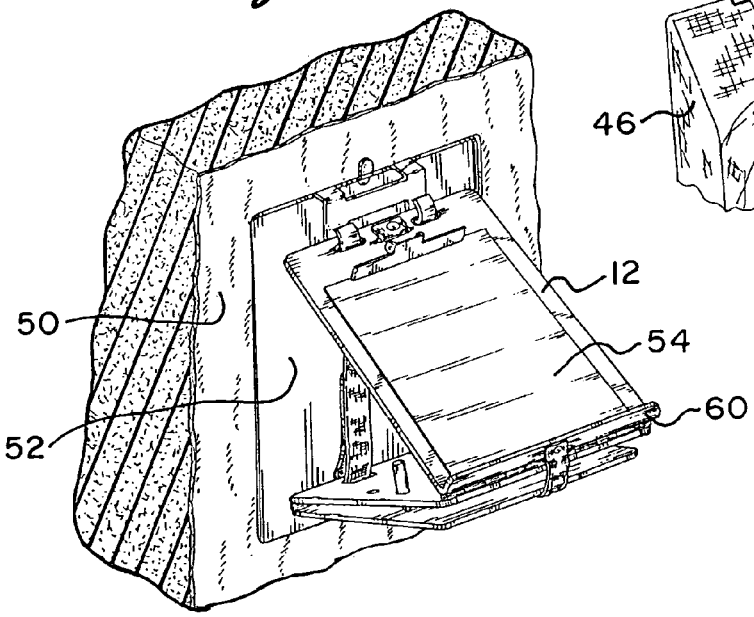
FIG. 10 illustrates the stand of the present invention being supported on the back of an airplane seat.

As shown most clearly in FIG. 10, the hook 42 can also be used to suspend the portable workstation stand 10 from the back of an airplane seat 50 that includes a stowable tray 52. As should be readily apparent, this is accomplished by slightly opening the tray, passing the hooks 42 over the top edge of the tray and then closing the same.

Figure 8:
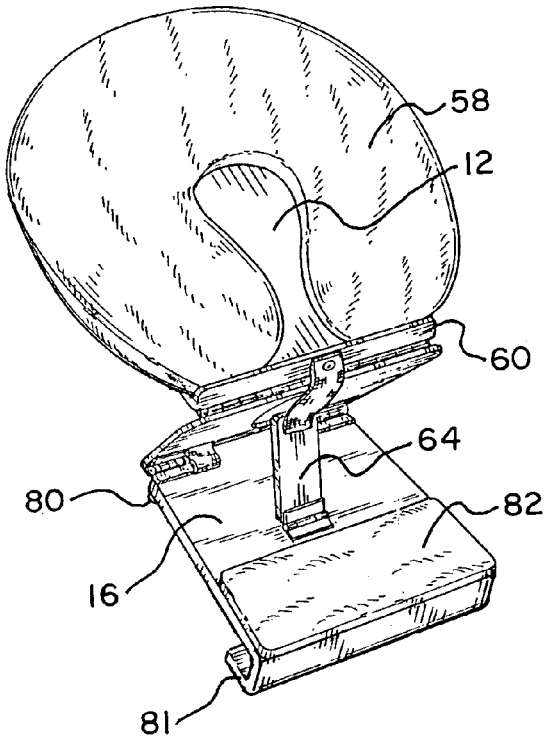
FIG. 8 illustrates the stand of the present invention being used as a head rest.
Figure 9:
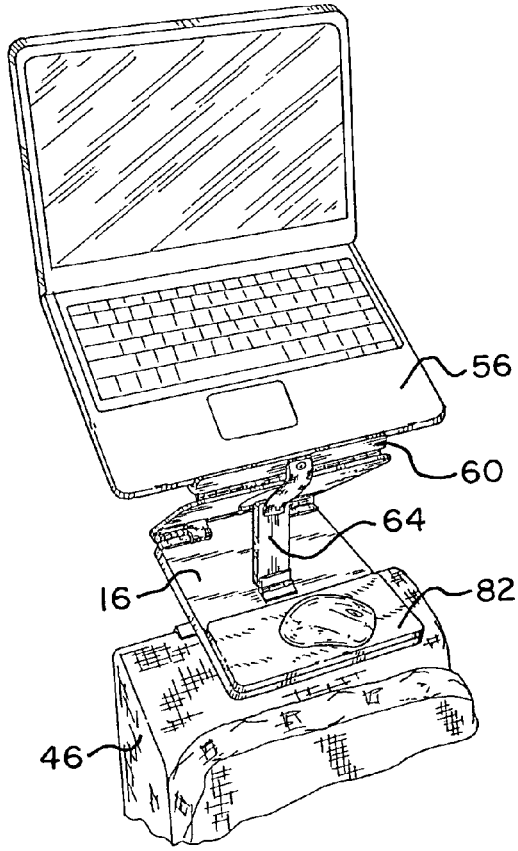
FIG. 9 illustrates the stand of the present invention being used as a desk for a portable computer.

With the portable workstation stand 10 suspended from the handle of the suitcase as shown in FIG. 6 or from the back of an airplane seat as shown in FIG. 10, various articles can be placed on the upper surface of the first panel 12. By way of example, the panel could hold a book or papers 54 as shown in FIG. 10, a laptop computer 56 as shown in FIG. 9 or a headrest 58 as shown in FIG. 8. A raised ledge 60 located at the lower edge 20 of the first panel 12 prevents any object resting on the panel 12 from sliding downwardly.

In lieu of suspending the portable workstation stand 10 from the top as shown in FIGS. 6 and 10, the stand can also be self supporting and rest on a table or other horizontal support surface. This is accomplished through the use of a pair of pivotally arranged rigid members 62 and 64. Member 62 has one end pivotally secured to the back of the first panel 12 as shown at 66 and has a free end 68 that is adapted to pivot downwardly and away from the rear surface of the panel 12. Velcro or other fastening means 70 temporarily maintain the rigid member 62 in its inoperative position as shown in FIG. 3. Similarly, the rigid member 64 is hinged at 72 to the upper surface of the lower panel 16 with its free end 74 suspended downwardly and temporarily held onto the surface through the use of Velcro or similar fasteners 76.

When it is desired to erect the portable workstation stand 10 and maintain it in its opened position, the panels 12, 14 and 16 are opened and the rigid member 62 is pivoted downwardly so that the free end 68 fits into a notch or opening 78 located adjacent the center of the second panel 14. Similarly, the free end 74 of the lower rigid member 64 is pivoted upwardly to fit into the notch 79 from the bottom. (See FIG. 4.) The rigid members 62 and 64, as interconnected between the panels 12, 14 and 16, thereby hold the panels in the open position such as shown in FIG. 8.

With the panels held in their open position, the entire device can be placed on a table or similar horizontal support surface. In order to prevent marring of the table, the lower surface of the lowermost panel 16 may be provided with rubber feet or the like such as shown at 80. The portable workstation stand 10, as supported on a desk or table, can then be used to support a headrest, or laptop computer, or papers or a book in essentially the same manner as if the device were suspended from the hook 42 as discussed above.

On certain surfaces such as an arm tray on an airplane, the workstation may have a tendency to move rearwardly. In order to prevent this from happening, the front edge of the lowermost panel 16 may be provided with a lip 81.

The collapsible and portable workstation stand 10 includes additional features that make the same useful for the traveling businessman, or student or the like. For example, a mouse pad 82 may be mounted on the upper surface of the lower panel 16. In addition, the second or middle panel 14 may be provided with a plurality of openings such as shown at 84 and 86. The opening 84 may be large enough to hold a drinking cup 88 or the like while the opening 86 is intended to hold a pen or pencil or other writing utensil.

The present invention may be embodied in other specific forms without departing from the spirit or essential attributes thereof and accordingly, reference should be made to the appended claims rather that to the foregoing specification as indicating the scope of the invention.

I claim:

1. A collapsible and portable workstation stand comprising:

first, second and third substantially rectangularly shaped and substantially rigid panels, each of said panels having a first edge and a second edge parallel to said first edge;

said first panel having its second edge hinged to the first edge of said second panel so as to be movable between a closed position and an open position relative to each other and said second panel having its second edge hinged to the first edge of said third panel so as to be movable between a closed position and an open position relative to each other;

flexible straps extending between said first and second panels and between said second and third panels to prevent said panels from fully opening with respect to each other;

rigid means movable between said first and second panels and between said second and third panels for maintaining said first, second and third panels in said open position hook means located adjacent the first edge of said first panel for supporting said collapsible stand from a horizontally arranged support with said first, second and third panels in partially opened positions with respect to each other.

2. The collapsible and portable workstation stand as claimed in claim 1 further including straps for securing said first panel to said horizontally arranged support.

3. The collapsible and portable workstation stand as claimed in claim 1 wherein said first panel includes a raised ledge adjacent said second edge thereof.

4. The collapsible and portable workstation stand as claimed in claim 1 wherein said second panel includes a plurality of openings formed therein.

5. The collapsible and portable workstation stand as claimed in claim 4 wherein at least one of said openings is capable of supporting a drinking cup.

6. The collapsible and portable workstation stand as claimed in claim 4 wherein at least one of said openings is capable of supporting a writing utensil.

7. The collapsible and portable workstation stand as claimed in claim 1 further including a plurality of feet at the bottom of said third panel whereby said stand can sit on a horizontal planar support surface.

8. The collapsible and portable workstation stand as claimed in claim 1 further including means for maintaining said panels in their closed position.

* * * * *